US006012174A

United States Patent [19]

Rech et al.

[11] Patent Number: 6,012,174

[45] Date of Patent: Jan. 11, 2000

[54] INTEGRAL SKIN FOAM HAT

[75] Inventors: Robert J. Rech, Wauwatosa; Thomas G. Hayden, Elm Grove, both of Wis.

[73] Assignee: Robert Jack, Inc., Elm Grove, Wis.

[21] Appl. No.: 09/288,441

[22] Filed: Apr. 8, 1999

Related U.S. Application Data

[60] Provisional application No. 60/083,188, Apr. 27, 1998.

[51] Int. Cl.[7] ..... A42B 1/00

[52] U.S. Cl. ..... 2/200.1; 2/195.1; 2/209.12; D2/896; D2/872

[58] Field of Search ..... 2/171, 195.1, 200.1, 2/209.11, 209.12; D2/869, 872

[56] References Cited

U.S. PATENT DOCUMENTS

| | | | |
|---|---|---|---|
| D. 372,571 | 8/1996 | Venditto, Jr. | D2/869 |
| D. 397,540 | 9/1998 | Chase | D2/869 |
| 4,747,164 | 5/1988 | Foulke | 2/171 |
| 4,989,356 | 2/1991 | Combs | 2/171 |

*Primary Examiner*—Diana Oleksa
*Attorney, Agent, or Firm*—Quarles & Brady LLP

[57] ABSTRACT

A foam hat depicting a race car has a smooth outer surface providing a more realistic depiction of the car by promoting the formation of a void free skin on the foam. The hat may include a pocket for the user's head as well as flanking pockets for beverage cans or the like so as to provide additional utility as a carrying tray.

4 Claims, 1 Drawing Sheet

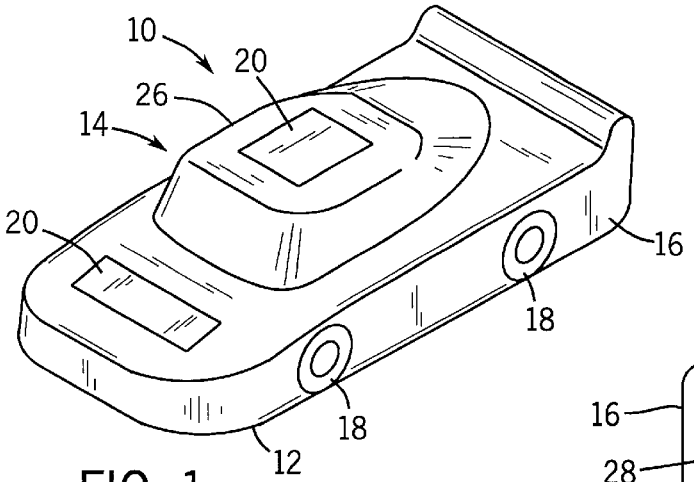
FIG. 1
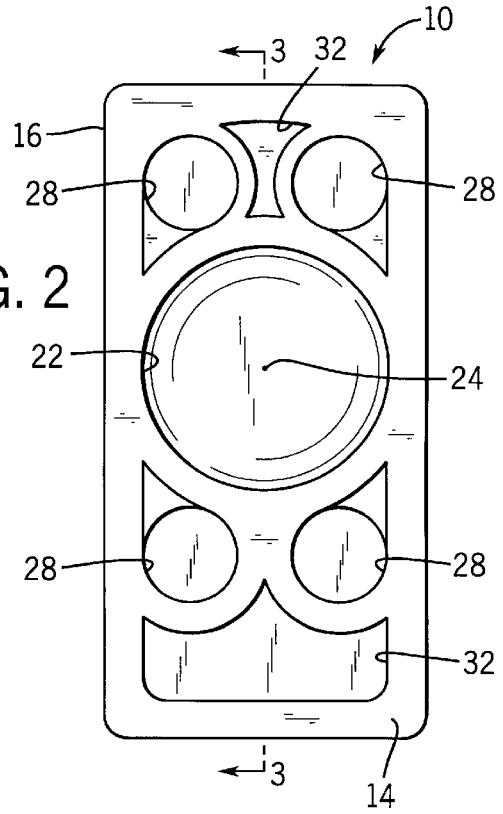
FIG. 2
FIG. 3
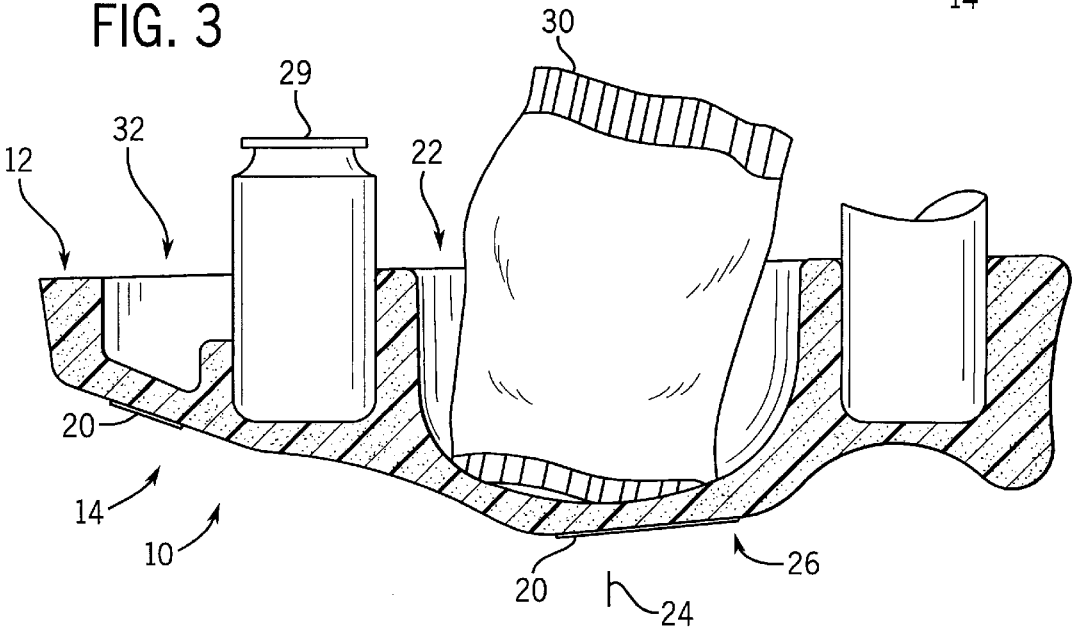

INTEGRAL SKIN FOAM HAT

CROSS-REFERENCE TO RELATED APPLICATIONS

This application is based on U.S. Provisional application 60/083,188 filed Apr. 27, 1998, hereby incorporated by reference, and claims the benefit of that provisional filing.

BACKGROUND OF THE INVENTION

The present invention relates to hats and, in particular, to molded foam hats.

A popular way of showing support for a sporting event or team is the wearing of an oversized hat depicting a symbol or theme of the team and its supporters. Large foam cowboy hats and foam cheese wedges are two examples.

The foam imparts to the outer surface of these hats a coarse granular texture that may be colored or spray painted as desired but is otherwise difficult to paint or print. This makes adding logos and sponsorship information on selected hats, after manufacture, impractical. Further, the coarse nature of present foam hats works best when a cartoon-like approximation of an object is acceptable. While the hats succeed at a distance, they are relatively unattractive from up close and thus are limited to use as headwear despite the significant cost of foam construction.

SUMMARY OF THE INVENTION

The present inventors have recognized that use of an integral-skin molded foam process can be used to provide foam hats with a smooth finished surface to which decals and stickers may be readily applied and which is more suitable for sporting events such as car races where representation of race cars aesthetically requires a more sophisticated and refined surface characteristic. The smooth surface provided by the integral skin foam technique better mimics the polished surface of the car making the hat attractive at close distances and thus suitable for display after its use as headwear.

A low profile car hat may be created by aligning the head hole necessary to fit over the user's head with the center of the car's roof. This also permits a hat with lighter weight. The remaining material of the hat may then be balanced so that the center of the head hole is also the center of mass of the car even though it may not be positioned at the center of the car's extent. Cavities may be placed flanking the head hole to hold standard beverage cans allowing the hat to serve a dual use as a food tray and sports headwear.

The foregoing and other objects and advantages of the invention will appear from the following description. In this description, references are made to the accompanying drawings which form a part hereof, and in which there are shown, by way of illustration, preferred embodiments of the invention. Such embodiments do not necessarily represent the full scope of the invention, however, and reference must be made therefore to the claims for interpreting the scope of the invention.

BRIEF DESCRIPTION OF THE SEVERAL VIEWS OF THE DRAWINGS

FIG. 1 is a perspective view of an integral skin foam hat constructed according to the present invention;

FIG. 2 is a plan view of the underside of the hat of FIG. 1 showing the head hole positioned beneath the center of the roof of the car of FIG. 1 flanked by beverage can holding cavities; and FIG. 3 is a cross-sectional view along lines 3—3 of FIG. 2 showing positioning of beverage cans to either side of the head hole and food items within the head hole when the hat is used as a tray and showing the centering of the head hole at the center of gravity of the hat despite its asymmetry.

DETAILED DESCRIPTION OF THE INVENTION

Referring now to FIG. 1, a foam hat 10 constructed according to the present invention presents a generally planar lower surface 12 and a molded upper surface 14, the latter conforming generally to the shape of an automobile but having an essentially continuous upwardly extending skirt 16 incorporating a relief allowing the hat 10 to be molded readily with a two part mold dividing along the planar lower surface 12. The hat 10, in a preferred embodiment, is constructed using cold molded two part flexible polyurethane foam. As is understood in the art, the inner surface of the mold is polished smooth and precoated with a pigmented paint layer that provides for adhesion by the introduced foam which adhesion causes the formation of a thin skin having a substantially continuous surface without voids conforming to the shape of the mold's inner surface. The pigment of the paint may color the skin an arbitrary color differing from that of the polyurethane itself.

The smooth molded upper surface 14 allows for the application of part decals 18 such as represent the wheels or label decals 20 as represent various logos or sponsorships for the automobile.

Referring now to FIG. 2, the under surface of the hat 10 includes an oval shaped head hole 22 conforming generally to an oblate hemisphere sized to accept an average size adult's head as accommodated also by flexure of the polyurethane foam. The head hole 22 is placed symmetrically about a center of mass 24 so that the hat 10 remains balanced on a user's head without undue torsion on the user's neck. Nevertheless, the head hole 22 is not symmetric with respect to the perimeter of the hat defined by the skirt 16 but is displaced so as to be centered under a roof 26 of the car representation molded into the molded upper surface 14. In this way, the overall height of the car may be reduced as conforms to true automotive dimensions while allowing sufficient depth for securely holding the hat on the user's head.

Specifically the upper surface of the hat conforms substantially to the shape of the upper surfaces of an automobile having a front hood section, a roof section and a rear hood section, the front hood section being longer than the rear hood section. The ability to displace the head hole 22 with respect to the skirt and yet to retain the head hole in position symmetrically about the center of mass 24 is provided by careful balancing of the material on both sides of the head hole 22 (through the use of balancing apertures in the preferred embodiment) so as to correctly center the center of mass 24 within it as will be understood from this description to one of ordinary skill in the art.

Referring now to FIGS. 2 and 3, flanking the head hole 22 are four beverage can receiving holes 28 opening upward from the planar lower surface 12 when the hat 10 is inverted as shown in FIG. 2. The can receiving holes 28 accept the bottom portions of the beverage cans 29 or the like and to support them with respect to the hat 10 to prevent their tipping and spilling. In this orientation of the hat 10, the head hole 22 may be used to hold other snack or food items 30. Other cavities 32 may be formed in the hat 10 so as to reduce its total weight and the material necessary to form it while retaining its balance at the center of mass 24 previously described.

In use, a customer may purchase a hat representing the team car which they support at a same vending location as sells food or beverages. The hat may be inverted to serve as a tray and a holder for the consumer's food which may then be removed and the hat used to show support for the particular team. The orientation of the hat is such as to provide for an effective eye shielding brim. Upon conclusion of the race, the consumer has a souvenir of high quality surface finish suitable for display on a shelf or a table.

The above description has been that of a preferred embodiment of the present invention. It will occur to those that practice the art that many modifications may be made without departing from the spirit and scope of the invention. In order to appraise the public of the various embodiments that may fall within the scope of the invention, the following claims are made.

We claim:

1. A car hat of expanded flexible plastic foam, comprising:

a polyurethane foam body having upper and lower surfaces, the upper surface being molded to resemble an automobile and the lower surface being molded to include a concave head-sized aperture extending into the foam body to receive a human head therein;

a thin, skin-like outer layer integral with the upper surface of the foam body having a pigment independent of the foam body, the pigmented outer layer being made integral with the foam body upper surface during molding so as to effect a continuous smooth, shiny and substantially void-free upper surface.

2. The car hat as recited in claim 1 wherein the lower surface further defines at least two concave beverage can openings extending into the foam body toward the pigmented smooth outer layer, the beverage can openings flanking the concave head-sized aperture.

3. The car hat as recited in claim 1 wherein the foam body has a front hood section, a roof section and a rear hood section, the front hood section being longer than the rear hood section and wherein the concave head-sized aperture is centered under the roof section and including further balancing apertures causing a center of mass of the car hat to be centered on the head-sized aperture.

4. The car hat as recited in claim 1, further comprising decals representing at least one of parts of an automobile and logos of race car sponsors, the decals being adhered to the smooth outer-layer covering the upper surface of the foam body.

* * * * *